US005497999A

United States Patent [19]

Stewart et al.

[11] Patent Number: 5,497,999

[45] Date of Patent: Mar. 12, 1996

[54] METHOD OF PLAYING A CARD GAME TEACHING GOLF RULES

[76] Inventors: Charles P. Stewart; Constance M. Stewart, both of 141 Brookside Ave., Caldwell, N.J. 07006

[21] Appl. No.: 415,551

[22] Filed: Apr. 3, 1995

[51] Int. Cl.[6] ..... A63F 1/00

[52] U.S. Cl. ..... 273/298

[58] Field of Search ..... 273/245, 298, 273/244

[56] References Cited

U.S. PATENT DOCUMENTS

| | | | |
|---|---|---|---|
| 1,143,595 | 6/1915 | Behring | 273/298 |
| 1,597,457 | 8/1926 | Moorman | 273/298 |
| 2,569,701 | 10/1951 | Thompson et al. | 273/298 |
| 4,289,315 | 9/1981 | O'Barr | 273/298 |
| 4,546,982 | 10/1985 | Gaines | 273/298 |
| 4,801,149 | 1/1989 | Alnafissa | 273/302 |
| 4,856,780 | 8/1989 | Begley et al. | 273/244 |
| 5,100,326 | 3/1992 | Leep et al. | 273/292 |
| 5,248,147 | 9/1993 | Smith | 273/244 |

FOREIGN PATENT DOCUMENTS

| | | | |
|---|---|---|---|
| 2220147 | 1/1990 | United Kingdom | 273/245 |

OTHER PUBLICATIONS

"Tee–Rivia", Worldwide Games catalog, Autumn 1994, p. 16.

*Primary Examiner*—Benjamin H. Layno
*Attorney, Agent, or Firm*—William Squire

[57] ABSTRACT

Each card in a deck is assigned any one of several par values, each card representing a hole in a golf game. The cards each have a given situation or problem on the front and a rule or solution on its rear. The cards are stacked front face up with each player receiving the same amount of cards and the same number cards of a given par value. The players take turns to answer the problem presented by a card in their stacks and, if correct, receive the par for that card or, if incorrect, a bogie. For bogies, other players may elect to answer the problem and, if correct, receive a birdie or, if incorrect a bogie, all players attempting to answer the problem until solved or all players have participated. The card is then discarded. Other games are disclosed using different playing sequences and methods of point tallying. A programmed computer may be substituted for a deck of cards and which deals the cards, displays the fronts and backs of each player's cards upon command, keeps track of each player's cards and discards the cards when instructed.

20 Claims, 3 Drawing Sheets

FIG. 1c

METHOD OF PLAYING A CARD GAME TEACHING GOLF RULES

BACKGROUND OF THE INVENTION

This invention relates to a card game, and more particularly, to a card game for teaching the rules of golf.

Card games for playing the game of golf are known and, for example, as shown in U.S. Pat. No. 4,546,982, simulate the game of golf. In this patent, a game comprising a deck of 52 cards and a score card are disclosed. Eight cards have the numeral zero, eight cards have the numeral ten and four cards each have a numeral from one to nine. The game is played with each player being dealt four cards two up and two down. When a player "putts," the hand having the lowest score wins the hole. Play continues until nine holes are played. The score is determined by the total points in a player's hand for each hole.

Other golf simulating games are illustrated in U.S. Pat. Nos. 4,289,315, 2,569,701, 4,546,982, 1,597,457 and 1,143,595. Other patents disclose educational games such as U.S. Pat. No. 4,801,149 which discloses a deck of 52 cards including questions and answers arranged in sets of answers and questions of different levels of skill. Cards have different values corresponding to the level of skill. The higher the skill the greater the number of questions on a card.

U.S. Pat. No. 5,100,326 illustrates flash cards for teaching and practicing blackjack. Each flash card has two playing situations presented in different sections on its front side in opposing orientations and at opposing card ends. The recommended action for a player to take when presented with each situation is printed in similar sections on the back of each flash card. Identifiers appear on each side of the cards to indicate a group of cards to which a card belongs, and the sequence of the card within that group.

The present inventors recognize a need for a card game for teaching the rules of golf that is both enjoyable and educational.

SUMMARY OF THE INVENTION

A method according to the present invention for teaching the rules of the game of golf employing a deck of cards, each of which cards has a front and a back, the deck comprising a plurality of portions, the cards of each portion manifesting the same given par value, the par values of the cards of the different portions being different, each card having a golf game playing situation on the front and a corresponding rule or solution to the situation on the back, the method comprising:

dealing a set of cards from each portion to each player in a stack in the same portion sequence with the front face up so that the total number of cards dealt to each player corresponds to the total number of holes in a golf game being played, each player receiving the same number of cards in each set; and playing the game by:

a) declaring by a first player the rule or answer to the situation on the top card of a first stack corresponding to the first player in a first sequence of players;

b) if the answer is correct by looking at the back of the selected top card, assigning the first player the par value manifested by that selected card and discarding that card from its stack;

c) in case of a wrong answer, assigning that first player at least an additional point added to the value of the par value manifested by that selected top card;

d) allowing a second player in a second sequence at the second player's option to provide the rule or answer to the card with the wrong answer;

e) assigning the value manifested by that top card less at least one point to the second player if the answer is correct and discarding the first player's selected top card and the top card of a second stack manifesting the same par value as the top card of the first player's selected first stack, the second stack corresponding to the second player;

f) if the answer is incorrect, assigning the second player at least an additional point added to the value manifested by that selected top card and discarding the top card of the selected second stack;

g) repeating steps a–c with each remaining player in the first sequence and repeating steps d–f for each incorrect answer when applicable in the second sequence;

h) totaling all the points of each player after all cards in all of the stacks have been played; and i) declaring the winner the player with the lowest amount of points.

In one embodiment, there are three portions, a first portion manifesting a par value of 3, a second portion manifesting a par value of 4 and the third portion manifesting a par value of 5.

In a further embodiment, the first and third portions comprise the same number of cards each.

In a further embodiment, a set of X cards is dealt, each card representing a hole, there are Y players and X/Y is an integer.

In a further embodiment, a method of teaching the rules of the game of golf employing a deck of cards, each of which cards has a front and a back, each card having a golf game playing situation on the front and a corresponding rule or solution to the situation on the back, the method comprising:

dealing a stack of the same number of cards to each player from a deck of X cards; and playing the game by:

a) assigning a plurality of Y players each having a playing turn in a sequence where X/Y is an integer;

b) drawing a card from the stack and declaring by a first player in the sequence the rule or answer to the situation on that card;

b) if the answer is correct by looking at the back of the selected card, assigning the first player a first given point value and discarding that card;

c) in case of a wrong answer, assigning that first player a second point value higher than the first point value;

d) repeating steps a–c for each player in the sequence in case of a wrong answer and discarding that card when play with that card is completed by all players;

e) repeating steps a–d for each player until all cards have been played;

h) totaling all the of points of each player after all cards in all of the stacks have been played; and i) declaring the winner the player with the least amount of points.

In a further embodiment of a method for teaching the rules of the game of golf employing a deck of cards, each of which cards has a front and a back, each card having a golf game playing situation on the front and a corresponding rule or solution to the situation on the back, the method comprising:

dealing a stack of cards to each player with the front face up, the number of cards in the stack representing the number of holes in the golf game being played; and playing the game by:

a) declaring by a first player the rule or answer to the situation on any card of that player's stack;
b) if the answer is correct by looking at the back of the selected card, assigning the first player a (+) point value and discarding that card;
c) in case of a wrong answer, assigning that first player a (–) point value;
d) allowing any further player on a first come first serve basis at that further player's option to provide the rule or answer to the card with the wrong answer;
e) assigning the further player a (+) point value if the answer is correct and (–) point value if incorrect, all the (+) and (–) point values being the same;
f) discarding that card when play with that card is completed;
g) repeating steps a–f until all cards have been played;
h) totaling all the of points of each player after all cards in all of the stacks have been played; and
i) declaring the winner the player with the most points.

IN THE DRAWING

FIGS. 1*a*, 1*b* and 1*c* are respective isometric diagrammatic representations of playing cards in respective first, second and third portions, each portion representing a given par value for each card in that portion and illustrating the front and rear faces of a card on the respective left and right sides of the drawing;

FIG. 2 diagrammatically illustrates a stack of playing cards dealt to each player; and FIG. 3 is a flow chart of one embodiment of the disclosed games employing the cards of FIGS. 1 and 2.

DETAILED DESCRIPTION OF THE INVENTION

Figure 1A:
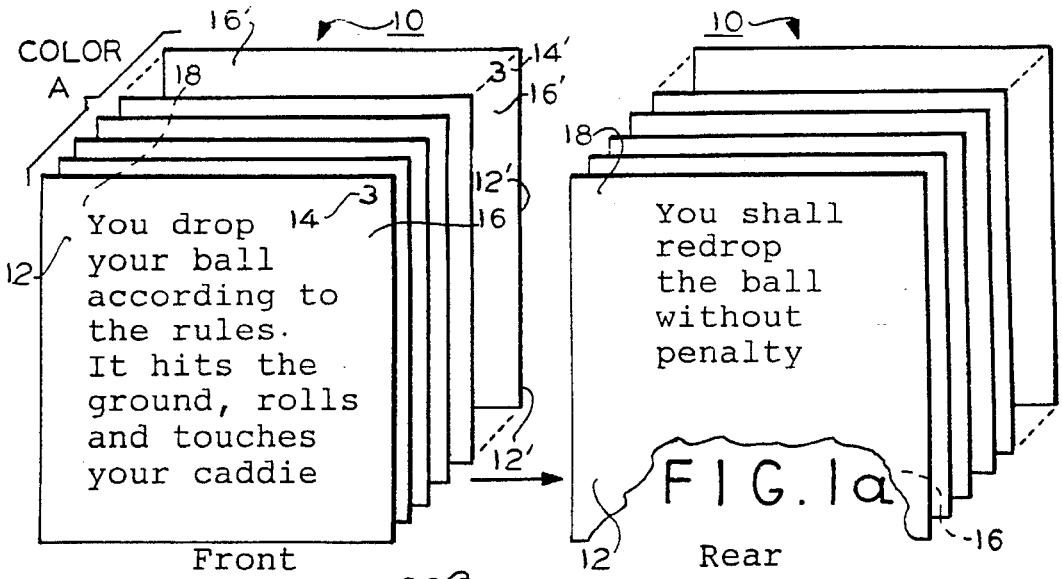
Figure 1B:
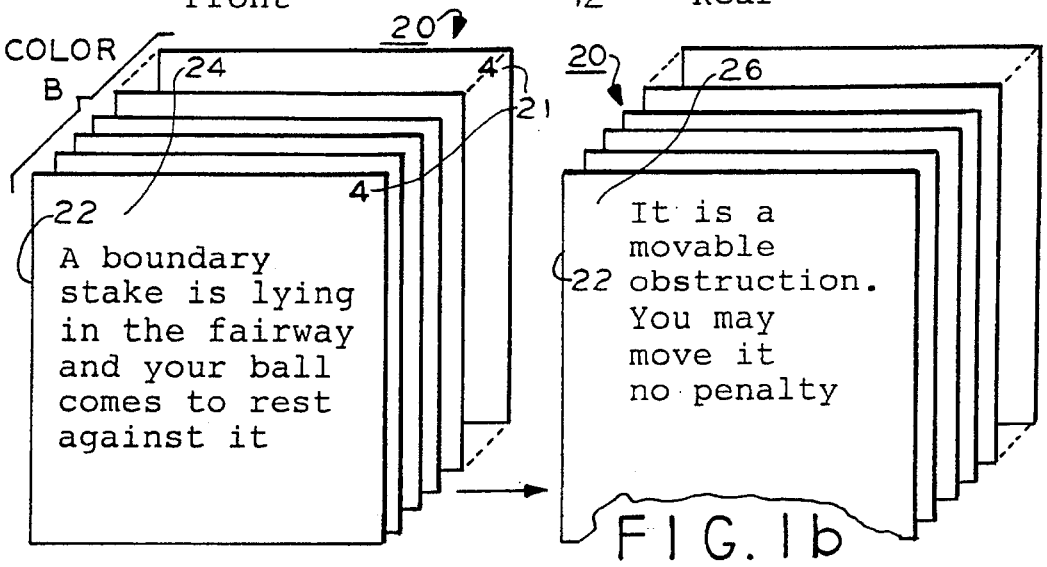
Figure 1C:
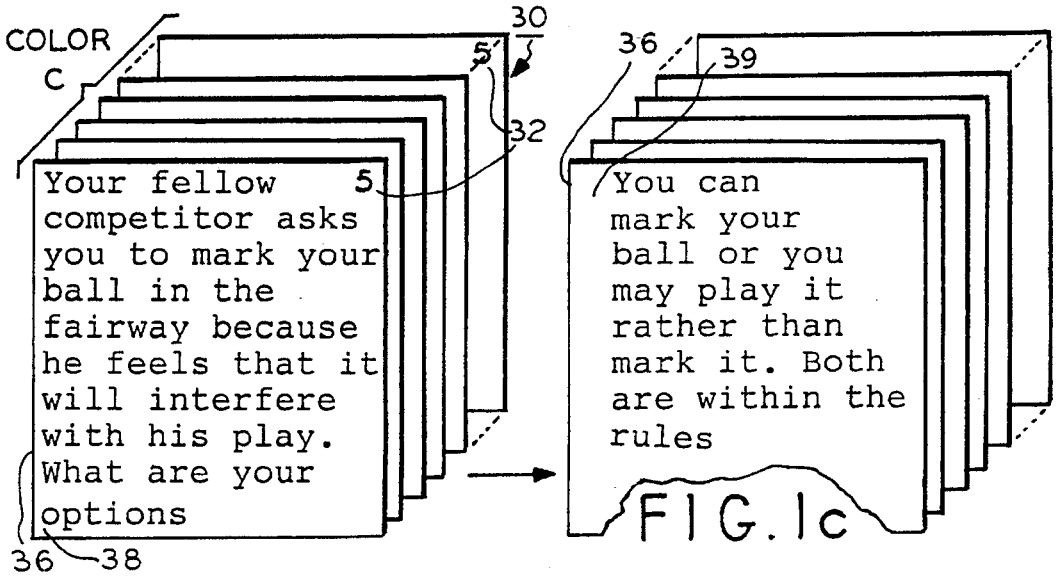

In FIG. 1*a*, a first portion 10 of a deck of cards shown in FIGS. 1*a*, 1*b* and 1*c* for playing one or more different golf games according to the present invention comprises a plurality of cards 12—12'. Each card in the deck represents a hole in the game of golf. Playing each card in the manner to be described results in a player being assigned a score or stroke value for that hole depending upon the player correctly or incorrectly playing that card as will be described.

The playing of each card serves to teach the player a correct rule for the corresponding situation so that upon playing the game with all cards the players all learn a significant number of rules as applicable to a variety of playing situations that may arise in an actual golf game.

Each card of the portion 10 has indicia 14 on a front face 16. Reference numerals that are primed refer to the same corresponding features identified with the same reference numerals without a prime. Indicia 14 represents a par value for a hole and is assigned the value 3 for each card of card portion 10. This value is arbitrary and could have other values if desired. The value 3 is used to represent typical golf courses which have par 3 holes. The cards are of any convenient size and may be 3 inch by 6 inches by way of example.

All cards in the deck such as representative card 12 each have a front face 16 and a rear face 18. The front face 16 is printed with a golf game situation that may occur during an actual golf game. For example, card 12 is printed on its front face 16 with the problem situation "you drop ball according to the rules. It hits the ground, rolls and touches your caddie." On the rear face 18 of card 12 the corresponding rule or solution to the problem situation is printed.

For example, for card 12 with the situation depicted on the front face, the rear face is imprinted with the solution "You shall redrop your ball without penalty." Every card in the playing deck is imprinted with a unique situation and corresponding rule or solution applicable to that situation on the respective front and rear faces.

Further, all cards of portion 10 have a unique color. The actual color used is arbitrary and may be solid, or spotted, striped or a unique pattern (not shown). The color, pattern and so on immediately identifies the par value of the associated card. The par value represents the points assigned to the player who correctly answers the situation with a correct answer or rule as depicted on that card's rear face. These points represent the player's score for that hole.

The cards of FIG. 1*b* represent a second portion 20 of the deck of cards. Portion 20 is assigned a par value 4 which is imprinted on the front face of each card at indicia 21. Also, each card of portion 20 is of the same color or pattern but different than the color or pattern of portion 10. The situation on the front face 24 of card 22 of portion 20 states: "A boundary stake is lying in the fairway and your ball comes to rest against it." The rear face 26 states the solution: "It is a movable obstruction. You may move it without penalty."

The cards of FIG. 1*c* represent a third portion 30 of the deck of cards. Portion 30 is assigned a par value 5 indicia 32 which is imprinted on the front face 34 of each card of portion 30. Also, each card of portion 30 is of the same color but different than the colors of portions 10 and 20. If a pattern is used, the same pattern may be used for all portions, but with different colors.

In the alternative, a different pattern may be used for each portion. In the latter case, for example, the par 3 cards may each have the same pictorial perspective representation of a golf course scene of a relatively short hole to be played including the tee off area connected to a putting green with a flagstick by a fairway and including bunkers about the putting green. The scene is background on the front face of each card.

Par 4 cards may each have the same longer hole pictorial perspective scene representation on each card. The par 5 cards may have the same pictorial scene representation of a longest hole. Also, the par values in large numerals and text may be one color and the pattern such as the pictorial representation of a hole may be in a different color, e.g., different shades of green.

The situation on the front face 38 of card 36 of portion 20 states: "Your fellow competitor asks you to mark your ball in the fairway because he feels that it will interfere with his play. What are your options?" The rear face 39 of card 36 states: "You can mark your ball or you may play it rather than mark it. Both are within the rules."

Similarly, every card in the deck is imprinted with its par value and with a golf game situation on its front face and the rule or solution on its rear face. Further examples of these are given below.

Figure 2:
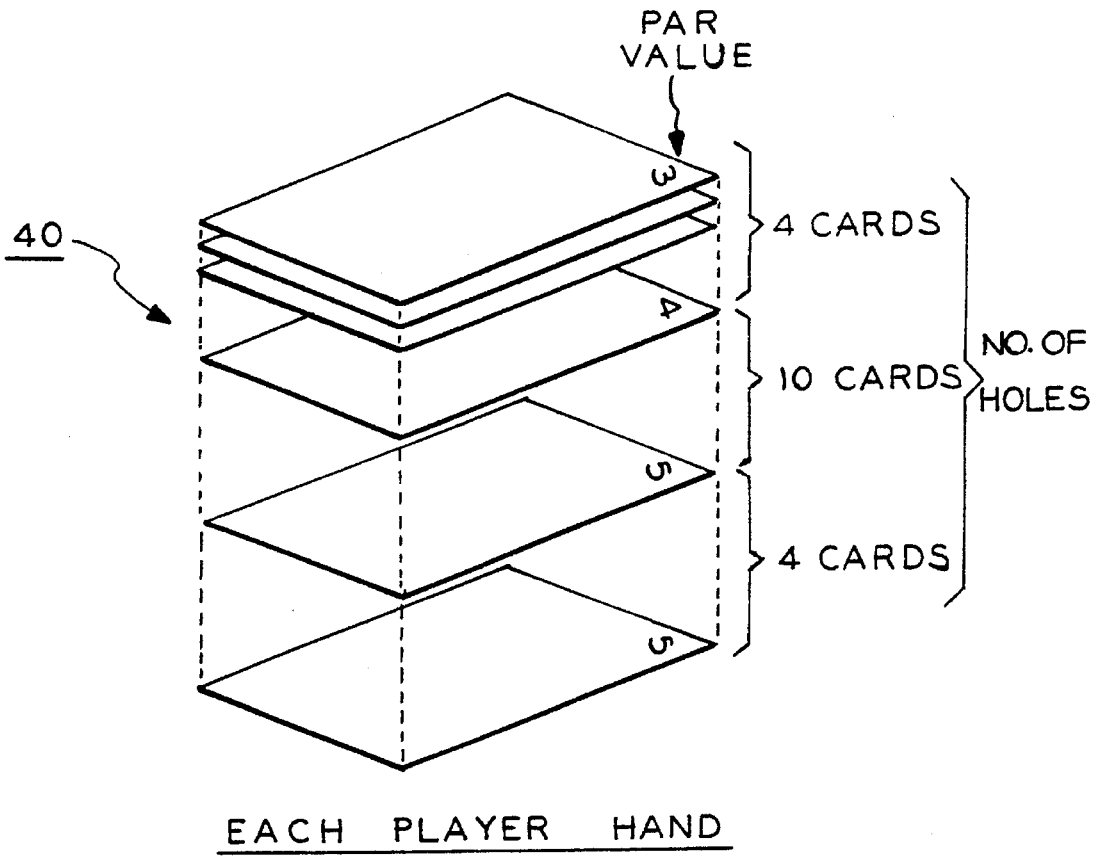

In FIG. 2, the players in a game are each dealt a stack of cards such as stack 40. The number of cards in the stack 40 represents the number of holes being played in a given game. In FIG. 2 for example the number of holes being played is eighteen. However, other values may be used in the alternative. The game does not depend upon the number of holes, per se, being played as it is the comparative score of the players for a given number of holes that are being played that is significant. That is, for any number of holes being played, the comparative score of the players for that number of holes determines the winner. This will be explained in more detail below.

Assuming eighteen holes is being played for a given game, the cards of each player's stack 40 are arranged with a number of cards from each portion 10, 20 and 30, (FIGS. 1*a*, 1*b* and 1*c*). In FIG. 2, for example, the stack 40 dealt each player comprises four cards from portion 10, par 3, ten cards from portion 20, par 4, and four cards from portion 30, par 5. The actual number of cards in each set of cards from a given portion is arbitrary and may be changed from game to game to add variety. The total number of cards in stack 40 comprises eighteen to represent a typical actual 18 hole golf course. In an actual golf course it is believed that there are more par 4 holes than par 3 and par 5. Therefore, a corresponding number of these par value cards are formed in a given stack.

Assuming a minimum of four players will play the game then 72 cards in a deck are required for an eighteen hole game. If a nine hole game is played then 36 cards are needed and so on. Further, the deck of 72 or 36 cards my be culled from a larger master deck of cards containing a larger population of par 3, par 4 and par 5 cards which are selected to form the 72 card deck for play. By arbitrarily selecting a 72 card deck from a larger deck, the situations and answers can be changed from game to game to add stimulation. Further, while three par value portions are provided these may be changed according to a given game. Thus, a given game may comprise cards from only a single par portion or two of the three portions as desired. For a 72 card deck there are 16 par 3's, 16 par 5's and 40 par 4's, for example.

An additional set of cards (not shown) is provided which gives the rules of the game and the directions for its play. The following are examples of situations and rules corresponding to those situations for a population of 17 par 3 cards, 68 par 4 cards and 17 par 5 cards forming a master deck of 102 cards from which the 72 card deck is selected. 16 par 3 and 16 par 5 cards are randomly selected from the par 3 and par 5 populations and 40 par 4 cards are randomly selected from the par 4 population of cards from the master deck.

It should be understood that the following golf rules are for medal or stroke play. Rules for match play of the game of golf are different. However, regardless which rules are employed, it is intended that the various rules of different golf games may be incorporated in the present invention methodology.

Rules For Stroke Play Golf

PAR 3 CARDS

| CARD NO. | CARD FRONT SITUATION | CARD REAR RULE |
|---|---|---|
| 1. | You drop your ball according to the rules. It hits the ground rolls land touches your caddie. | You shall redrop the ball without penalty. |
| 2. | You are making your tee shot on the ninth hole when your fellow competitor drops a ball and it rolls in front of you. Surprised, you make a bad shot and your ball lands only a few feet in front of you. | You must play it as it lies. |
| 3. | Your ball has come to rest on a cart path. Your nearest point of relief is a puddle of casual water. | You are entitled to relief without penalty. You must determine the point on the course, nearest to where the ball originally lay on the cart path. A point which is no nearer to the hole/avoids interference from the cart path and the casual water and is not in a hazard or on a putting green. Lift and drop within one club length. |
| 4. | You are playing in a stroke play tournament. Before going to the first tee you would like to practice your chipping. is this allowed under the rules? | Yes |
| 5. | You find a club lying on the course. You pick it up and put it in your bag. This means you have 15 clubs in your bag. You turn it in after your round. Even though you did not use the club, was this a breach of a rule? | No. |
| 6. | When do you have the right to declare your ball unplayable? | Any place on the course except when your ball is in a water hazard you take a one stroke penalty. |
| 7. | You are playing in a foursome stroke play tournament. You and your partner correctly calculate your combined handicap allowance and record it on the score card. You do not state your individual handicaps. Is this OK? | You are both disqualified. It is a player's responsibility to see that his handicap is recorded on his score card. |
| 8. | You are on the tee of a par 3 hole. You make your tee shot. You think that the ball hit the green but your view is obscured by the pin placement. There is a possibility that your ball bounced out of bounds so you hit a provisional ball. You search for your original, declare it lost and continue with the provisional. You then find your original ball, It's in the hole. | Your original ball counts. The hole was completed when you holed out so there are no penalties. |
| 9. | You address the ball on the tee and accidentally knock the ball off the tee. | You may re-tee the ball with no penalty. |
| 10. | You place your club on the ground parallel to your line of play, to help you with your alignment. You lift it before you play your stroke. | No penalty as long as you have removed the club before you play your stroke. |
| 11. | You strike your ball and it runs down the fairway and comes to rest on a | You may play the ball as it lies or proceed under the rules "from |

-continued

PAR 3 CARDS

| CARD NO. | CARD FRONT SITUATION | CARD REAR RULE |
|---|---|---|

-continued

PAR 3 CARDS

| CARD NO. | CARD FRONT SITUATION | CARD REAR RULE |
|---|---|---|
| | bridge across a water hazard. | the hazard" with one stroke penalty. |
| 12. | Your ball has come to rest on a cart path. | You must determine your nearest point of relief not nearer to the hole and drop your ball within one club-length; there is no penalty. |
| 13. | You address your ball on the tee and make a stroke on the ball. Your ball falls off the tee and rolls an inch or two. | The stroke counts but there is no penalty. |
| 14. | You are playing in a two-day golf tournament at your club. It is being played on Saturday and Sunday. On Saturday evening you decide to go and play a few holes. Are you permitted to do this? | If you do, you are disqualified. |
| 15. | You are in a situation-where you must drop your ball. You do so correctly but your ball rolls out of bounds. | You re-drop with no penalty. |
| 16. | After playing a round, you turn in your signed and attested score card to the committee. You realize later, in going back over your round, that you took a 7 on the fourth hole and you should have taken a 6. | The score stands as is but no penalty is incurred. |
| 17. | You turn in your score card after a tournament and it is discovered that although your hole-by-hole scores are correct, your total score was added incorrectly and is wrong. | You are responsible only for the correctness of the hold-by-hole score. The committee is responsible for the addition and total score. |

PAR 4 CARDS

| CARD NO. | CARD FRONT SITUATION | CARD REAR RULE |
|---|---|---|
| 18. | A boundary stake is lying in the fairway and your ball comes to rest against it. | It is a moveable obstruction. You may move it. No penalty. |
| 19. | Your fellow competitor asks you how far it is from the fairway bunker where his ball lies to the green. You tell him the distance. Is this giving advice? | No. The distance from the bunker to the green is a matter of record. |
| 20. | You are playing a round in rainy conditions. The grips on your clubs become wet and slippery. When you make the turn after 9 holes, you replace some of your clubs with extras you keep in your locker. Can you "under the rules" do | There is a 2-stroke penalty for each hole that you played with the replacement clubs. Maximum of 4 strokes per round. |

-continued

PAR 4 CARDS

| CARD NO. | CARD FRONT SITUATION | CARD REAR RULE |
|---|---|---|
| | this? | |
| 21. | You bend your putter after throwing it in anger. You then use it to make a putt. Can you legally do this? Is there a penalty? | You are disqualified. |
| 22. | Your ball lies on the putting surface. There is a drain between your ball and the hole. | You may lift and clean the ball and place it in the nearest position which gives you relief from the interference, no nearer to the hole. |
| 23. | You are playing a round on a Florida golf course. After making a stroke on your ball, it comes to rest two feet from an alligator. | You may, without penalty, drop a ball at the nearest spot, no nearer to the hole, that is not dangerous. |
| 24. | After marking your ball on the green, you knock it aside rather than lift it. | There is no penalty unless you knocked it aside for the purpose of testing the putting surface. |
| 25. | You think that your ball went into the bunker but when you reach the bunker, all you can see is the outline of a ball under the sand. | You may remove, by probing or raking or other means, as much as you need to in order to identify your ball. If an excess is removed, no penalty is incurred and the ball shall be recovered. If you move the ball, there is no penalty. The ball shall be replaced. |
| 26. | You address your ball in the fairway, make your stroke and hook it out of bounds. | You must play a ball as nearly as possible to the spot from which the original ball was placed. One stroke penalty. |
| 27. | You turn in your signed and attested score card after the completion of your round. You realize afterward that you took a 4 on a par 3 and it should have been a 5. | You are disqualified. |
| 28. | You think that your ball went into a tree. You can see a ball wedged high up in the tree but cannot identify it. | As you cannot identify your ball, it is considered lost and you must proceed accordingly. |
| 29. | Your ball comes to rest on a line that defines the out of bounds. Is the ball out of bounds or in play? | When out of bounds is defined by a line on the ground, the line itself is out of bounds. |
| 30. | Your fellow competitor reaches the green before you and, as a courtesy, marks your ball for you. | There is no penalty but the competitor must replace the ball. |
| 31. | Your ball is resting against the flagstick in the upper portion of the hole. You or your caddie may remove the flagstick. As it is being removed, the ball pops out and lands a foot away. | You may replace it on the lip of the hole. |
| 32. | Your ball comes to rest on the side of a post | The line of out of bounds is determined |

-continued

PAR 4 CARDS

| CARD NO. | CARD FRONT SITUATION | CARD REAR RULE |
|---|---|---|
| | that marks the "out of bounds." Is the ball in play or out of bounds? | by the inside points of the posts. Your ball is out of bounds. |
| 33. | Part of your ball lies on the margin of the water hazard but does not touch the ground or grass inside the hazard. Is the ball considered in the hazard? | Any ball that lies in, touches or is lost in the water hazard is deemed to be in the hazard. |
| 34. | Your ball has come to rest in the rough, close to the fairway. You are entitled to relief from an immovable obstruction. Can you drop it in the fairway? | Yes. |
| 35. | In a stroke play tournament you and three of your fellow competitors have an 8:30 a.m. tee-off time. Your fellow competitors are on time and, after waiting for you for ten minutes, they tee off. You come rushing in as they are going down the first hole. | You are disqualified. |
| 36. | In a stroke play tournament, the weather is so bad that you decide to pick up and go in. Your fellow competitor does the same. A while later, the committee cancels the round and reschedules it. Are you and your fellow competitor entitled to play? | Yes. All penalties are cancelled when the round is cancelled. |
| 37. | You are playing a round with a fellow competitor. You hurt your back so you withdraw from the tournament and stop playing. You continue to mark your fellow competitor's card and to carry his clubs in your cart. Is this permissible? | Yes. You became his caddie as well as his marker. |
| 38. | You approach what you think is your ball lying in the rough. It is covered with bits and pieces of grass and sticks so you cannot identify it. | You may lift the ball for identification and clean it to the extent necessary for identification. However, before lifting, you must announce your intention to your fellow competitor and mark your ball. You must give him/her the opportunity to observe. If you do not or if you clean more than is necessary, one stroke penalty and the ball shall be replaced. |
| 39. | You and your caddy are searching for your ball which disappeared into a stand of trees. Your | There is a one-stroke penalty for failure to announce your intention. |

-continued

PAR 4 CARDS

| CARD NO. | CARD FRONT SITUATION | CARD REAR RULE |
|---|---|---|
| | caddy sees a ball and lifts it to identify it. | |
| 40. | You tee off and then realize you were outside the teeing ground. | You incur a penalty of two strokes and you must then play a ball from inside the teeing ground. |
| 41. | You hit a beautiful shot right down the middle of the fairway and then discover that you played your competitor's ball. | You incur a 2-stroke penalty unless you were hitting out of a hazard, in which case there is no penalty. |
| 42. | Your second shot on a long par 5 goes out of bounds. | You shall drop a ball as nearly as possible to the place where the original ball was placed. One stroke penalty. |
| 43. | Your ball comes to rest on a moveable obstruction. Under the rules, may you lift your ball? May you remove the obstruction? May you clean your ball? | Yes to all three. |
| 44. | You find your ball in the rough, half buried. You announce your intention to your fellow competitor to identify your ball. You turn the ball and see that it is yours. | You incur a one-stroke penalty for not marking your ball before you moved it. |
| 45. | You take a practice swing and accidentally move your ball with your club. | You have not made a stroke as you had no intention of moving the ball. You do incur one penalty stroke for moving your ball in play. You must replace the ball. |
| 46. | Your ball is at rest on the putting green. A gust of wind moves it about 3 feet further away from the hole. | You play the ball as it lies. |
| 47. | You are taking relief under a rule which says you may drop a ball within 2 club lengths. You do so correctly but your ball lands in deep grass, giving you a very bad lie. Can you redrop? | No, you may not. |
| 48. | Your putting stroke sends your ball off line and your ball strikes the ball of your fellow competitor. | You incur a 2-stroke penalty. |
| 49. | You are lining up to putt your ball and your fellow competitor points out a big break to the left. | Your competitor incurs a two-stroke penalty for giving advice. |
| 50. | You are in a tournament. You discover, after playing the first hole, that you have 15 clubs in your bag. You tell your fellow competitor, who does not wish to apply the two-stroke penalty because you did not use the club. You declare the club out of play and continue your round. | You are both disqualified for agreeing to waive a penalty. |
| 51. | You are on the putting | You are deemed to be |

PAR 4 CARDS

| CARD NO. | CARD FRONT SITUATION | CARD REAR RULE |
|---|---|---|
| | surface trying to see which way the grain of the grass is growing. You reach down and run your hand over it. Can you do this without penalty? | testing the surface and, under the rules, receive a two-stroke penalty. |
| 52. | You played your ball from outside the teeing ground and it went out of bounds. You then play another ball from within the teeing ground. Do you incur a penalty? What is it? | You receive a two-stroke penalty for playing outside the teeing ground. There is no out-of-bounds penalty because your first ball was not in play. |
| 53. | Your ball lands in the fairway, strikes a ball at rest and is deflected into the rough. | Play it as it lies. there is no penalty or relief. |
| 54. | You are playing a round with a fellow competitor who is having trouble with his swing. You tell him to slow his swing down, that he has no tempo. | You incur a 2-stroke penalty for giving advice. |
| 55. | You find yourself in a situation that calls for you to drop a ball. What is the correct way under the rules to do this? what is the penalty if it is not done correctly? | You stand erect, hold the ball at shoulder height and arm's length and drop it. If it is not done in this manner and not corrected before a stroke is played, you incur a one-stroke penalty. |
| 56. | You gave your ball a mighty blow which sent it flying into a tree where it ricocheted into some shrubbery. You cannot see it. You know it's in there. Can you, under the rules, pull the shrubbery aside to look for your ball? | Yes, but only to the extent to find and identify your ball. |
| 57. | You see your ball go into a large pipe in the hazard. You try to reach it but you can't get it out. | You may drop a ball within the hazard and then proceed under the rules of being in a hazard, taking the one-stroke penalty. |
| 58. | You hit a three wood from the fairway. The ball runs down the side of the fairway and bounces into the rough. It hits your golf bag, which is being tended by your caddy. The ball comes to rest about 5 feet in front of your bag. | You incur a two-stroke penalty and play the ball as it lies. |
| 59. | Your ball comes to rest in bounds next to a hole from which a boundary stake had been removed. The stake is lying a few feet away. If the stake was in the hole, it would interfere with your swing. | You need not replace the stake. Play on. |
| 60. | You are playing a round with 14 clubs in your bag. Somewhere on the course, during the first | No. |

PAR 4 CARDS

| CARD NO. | CARD FRONT SITUATION | CARD REAR RULE |
|---|---|---|
| | five holes, you lose your (8) iron. May you replace it during the round? | |
| 61. | You are playing a round with a fellow competitor. You hurt your back so you withdraw from the tournament and stop playing. You continue to mark your fellow competitor's card and to carry his clubs in your cart. Is this permissible? | Yes. You became his caddy as well as his marker. |
| 62. | You approach what you think is your ball lying in the rough. It is covered with bits and pieces of grass and sticks so you cannot identify it. | You may lift the ball for identification and clean it to the extent necessary for identification. However, before lifting, you must announce your intention to your fellow competitor and mark your ball. You must give him/her the opportunity to observe. If you do not or if you clean more than is necessary, one stroke penalty and the ball shall be replaced. |
| 63. | You and your caddy are searching for your ball which disappeared into a stand of trees. Your caddy sees a ball and lifts it to identify it. | There is a one-stroke penalty for failure to announce your intention. |
| 64. | You tee off and then realize you were outside the teeing ground. | You incur a penalty of two strokes and you must then play a ball from inside the teeing ground. |
| 65. | You hit a beautiful shot right down the middle of the fairway and then discover that you played your competitor's ball. | You incur a 2-stroke penalty unless you were hitting out of a hazard, in which case there is no penalty. |
| 66. | Your second shot on a long par 5 goes out of bounds. | You shall drop a ball as nearly as possible to the place where the original ball was played. One-stroke penalty. |
| 67. | Your ball comes to rest on a moveable obstruction. Under the rules, may you lift your ball? May you remove the obstruction? May you clean your ball? | Yes to all three. |
| 68. | You find your ball in the rough, half buried. You announce your intention to your fellow competitor to identify your ball. You turn the ball and see that it is yours. | You incur a one-stroke penalty for not marking your ball before you moved it. |
| 69. | You take a practice swing and accidentally move your ball with your club. | You have not made a stroke as you had no intention of moving the ball. You do incur one penalty |

-continued

PAR 4 CARDS

| CARD NO. | CARD FRONT SITUATION | CARD REAR RULE |
|---|---|---|
| | | stroke for moving your ball in play. You must replace the ball. |
| 70. | Your ball is at rest on the putting green. A gust of wind moves it about 3 feet further away from the hole. | You play the ball as it lies. |
| 71. | You are taking relief under a rule which says you may drop a ball within 2 club lengths. You do so correctly but your ball lands in deep grass, giving you a very bad lie. Can you redrop? | No, you may not. |
| 72. | Your putting stroke sends your ball off line and your ball strikes the ball of your fellow competitor. | You incur a 2-stroke penalty. |
| 73. | You are lining up to putt your ball and your fellow competitor points out a big break to the left. | Your competitor incurs a two-stroke penalty for giving advice. |
| 74. | You are in a tournament. You discover, after playing the first hole, that you have 15 clubs in your bag. You tell your fellow competitor, who does not wish to apply the two stroke penalty because you did not use the club. You declare the club out of play and continue your round. | You are both disqualified for agreeing to waive a penalty. |
| 75. | You are on the putting surface trying to see which way the grain of the grass is growing. You reach down and run your hand over it. Can you do this without penalty? | You are deemed to be testing the surface and, under the rules, receive a two-stroke penalty. |
| 76. | You played your ball from outside the teeing ground and it went out of bounds. You then play another ball from within the teeing ground. Do you incur a penalty? What is it? | You receive a two-stroke penalty for playing outside the teeing ground. There is no out of bounds penalty because your first ball was not in play. |
| 77. | Your ball lands in the fairway, strikes a ball at rest and is deflected into the rough. | Play it as it lies. there is no penalty or relief. |
| 78. | You are playing a round with a fellow competitor who is having trouble with his swing. You tell him to slow his swing down, that he has no tempo. | You incur a 2-stroke penalty for giving advice. |
| 79. | You find yourself in a situation that calls for you to drop a ball. What is the correct way under the rules to do this? What is the penalty if it is not done correctly? | You stand erect, hold the ball at shoulder height and arm's length and drop it. If it is not done in this manner and not corrected before a stroke is played, you incur a one-stroke penalty. |
| 80. | You gave your ball a | Yes, but only to the |

-continued

PAR 4 CARDS

| CARD NO. | CARD FRONT SITUATION | CARD REAR RULE |
|---|---|---|
| | mighty blow which sent it flying into a tree, where it ricocheted into some shrubbery. You know it's in there. Can you, under the rules, pull the shrubbery aside to look for your ball? | extent to find and identify your ball. |
| 81. | You see your ball go into a large pipe in the hazard. You try to reach it but you can't get it out. | You may drop a ball within the hazard and then proceed under the rules of being in a hazard, taking the one-stroke penalty. |
| 82. | You hit a three wood from the fairway. The ball runs down the side of the fairway and bounces into the rough. It hits your golf bag which is being tended by your caddy. The ball comes to rest about 5 feet in front of your bag. | You incur a two-stroke penalty and play the ball as it lies. |
| 83. | Your ball comes to rest in bounds next to a hole from which a boundary stake had been removed. the stake is lying a few feet away. If the stake was in the hole, it would interfere with your swing. | You need not replace the stake. Play on. |
| 84. | You are playing a round with 14 clubs in your bag. Somewhere on the course, during the first five holes, you lose your (8) iron. May you replace it during the round? | No. |

PAR 5 CARDS

| CARD NO. | CARD FRONT SITUATION | CARD REAR RULE |
|---|---|---|
| 85. | Your fellow competitor asks you to mark your ball in the fairway, because he feels that it will interfere with his play. What are your options? | You can mark your ball or you may play it rather than mark it. Both are within the rules. |
| 86. | After playing four holes, you and your fellow competitor mistakenly go to the seventh tee and from there you play the seventh and the eighth hole before you realize your mistake. | You and your fellow competitor are disqualified if you play a stroke from a wrong teeing ground, you must correct your error before teeing off on the next hole. |
| 87. | You have played out of turn from the tee. Your fellow competitors request that you play in the correct order. You, in the proper order, play another ball. | You, under the rules, can correct yourself and play in the proper order with no penalty. However, when you played another ball, the original ball was lost and the second ball was in play. One penalty stroke (and distance). |

-continued

PAR 5 CARDS

| CARD NO. | CARD FRONT SITUATION | CARD REAR RULE |
|---|---|---|
| 88. | You are on the green and it is raining heavily. You ask your caddie to hold your umbrella over your head while you putt. | You may not accept physical assistance or protection from the elements while making a stroke two stroke penalty. |
| 89. | On the putting green, your fellow competitors ball is approximately ten feet further from the hole than yours. He putts it to within three feet of the hole and walks up to hole out. You object and claim the right to putt first. | Your fellow competitor is entitled to play out of turn provided he does not lift his ball. There is no penalty for putting out of turn. |
| 90. | You and your fellow competitor are on the green. You remove the flagstick and place it to one side on the green. You putt your ball and as you do, your competitor, fearing your ball will strike the flagstick, picks it up which allows your ball to roll by. | Your fellow competitor incurs a 2 stroke penalty for removing an obstruction which might influence the movement of the ball. |
| 91. | Your foursome is going from the fifth green to the sixth tee when play is suspended because of lightening. You all decide to tee off on six because it is on your way in. | You are all disqualified. |
| 92. | You have lost your ball in the water hazard. You drop a ball correctly behind the hazard and play it. You then find your ball in the hazard. | When you dropped the ball behind the hazard, that ball became the ball in play. Your original ball was no longer in play. You incurred a two stroke penalty. |
| 93. | You approach your ball at rest in the rough. Your foot moves a stick which in turn moves your ball. | You are deemed to have moved the ball and you incur a one stroke penalty. |
| 94. | You return your score card after playing, unaware that you recorded your scores for the front nine in the boxes for the back nine and vice-versa. | You are disqualified if any score given on a hole was lower than actually taken. |
| 95. | Your ball lies in the middle of the fairway. You ask your fellow competitor how far it is to the green. He tells you that it is about 100 yards. Have either of you breached a rule? If so, is there a penalty? | You each incur a two stroke penalty for asking and giving advice. |
| 96. | You are preparing to chip a shot onto the green and your caddy points out the line by touching the green with a club. Is this permissible? Is there a Penalty? | Your ball was off the putting surface. There was no breach of a rule. |
| 97. | Your ball lands on the wrong putting green. | You must determine the point on the course nearest to where the ball lies, not nearer to the hole, not in a hazard or on a putting green. You lift the ball, you may clean it and drop it without penalty within one club length. |
| 98. | You tee off on the first hole putting a pretty good slice on the ball. You lose sight of the ball and there's a possibility that it went out of bounds, you announce and then hit a provisional ball. When you reach the area where your ball was last seen, you find it in bounds but under a shrub. Your provisional ball is in the fairway. | You must abandon the provisional ball and continue play with your original ball. If you fail to do so, any further strokes with the provisional shall constitute playing a wrong ball and incur a 2 stroke penalty. |
| 99. | You are playing in a stroke play tournament. Your fellow competitor fails to hole out by "taking" a two inch putt. You know this but you sign and attest his score card. Was this a breach of a rule? By whom? | You are both disqualified. |
| 100. | You are playing with a partner in a better ball competition. Your partner stands behind you on your line of putt while you are making your stroke. | Your partner may not position himself anywhere on or close to your line of putt. Two stroke penalty. |
| 101. | You drop your ball under a rule which says you must drop within two club lengths. You do so and your ball lands within the two club lengths but rolls outside that distance. | You shall redrop with no penalty. |
| 102. | From the tee, you drive your ball out of bounds. Under the rules, you play a ball as nearly as possible from where the original ball was played. May the ball be teed up? | There is a one stroke penalty (and distance). Yes you may tee it up. |

Several different golf games can be played by any number of players employing the cards described above. For example the games played can correspond to golf games such as medal play, match play, Stableford Tournament or 19th hole scramble. All games are played at scratch, that is, no handicap. Of course handicaps can be assigned according to the skill of the different players. Handicaps assigned can be arbitrary. Preferably, no handicaps are used.

Figure 3:
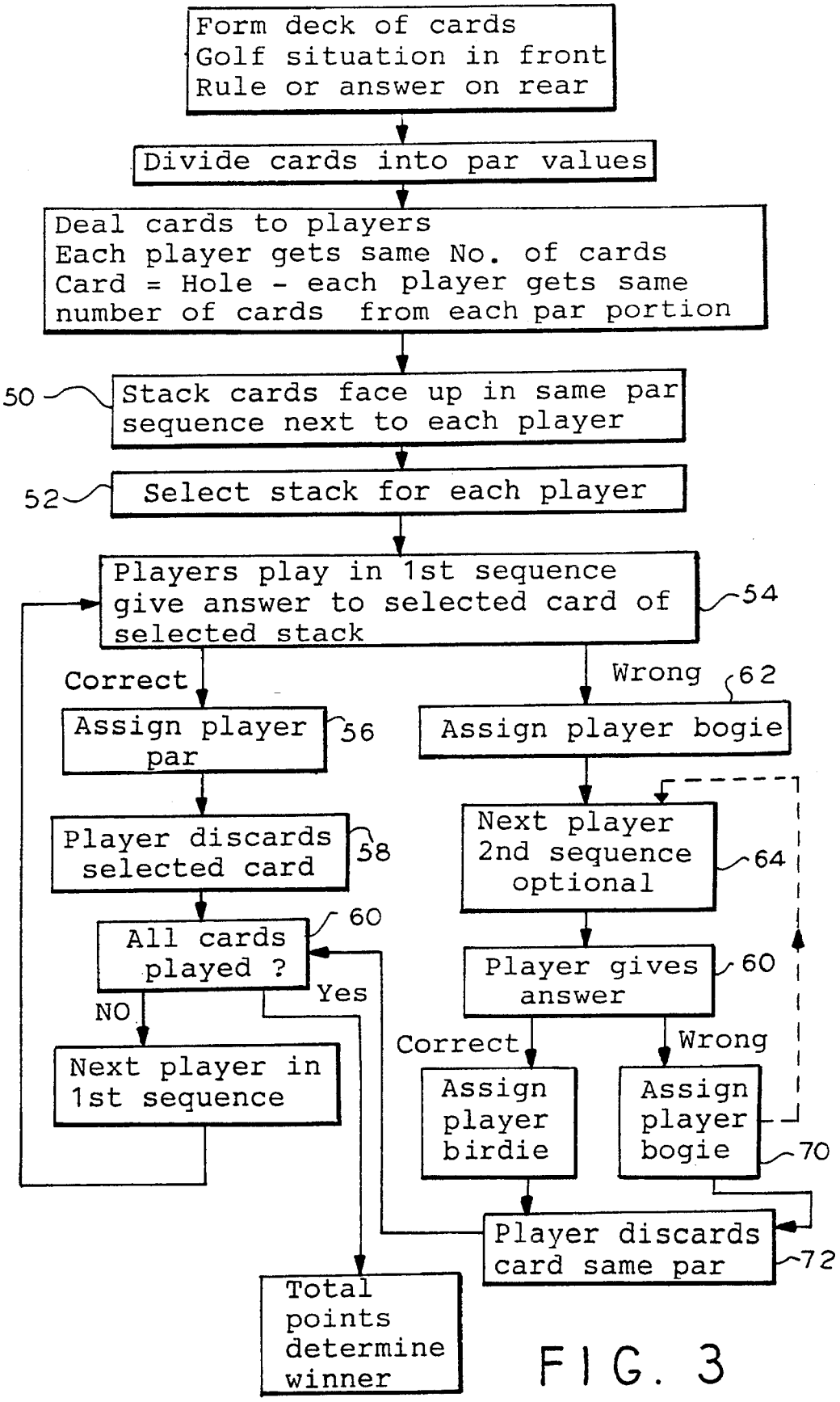

In medal play, each player, from two to four players, is dealt four par 3's, ten par 4's and four par 5's from a deck culled from the master population cards, step 50, FIG. 3. The stacks in step 52 are assigned to each player. Preferably, the stack in front of each player is assigned to that player. In alternative games, the first player may select a stack in front of the next adjacent player or any other agreed to player. The play proceeds in sequence from that player to each other player either to the left or right of the first player. Each player has an assigned stack of cards that is agreed to by the players as corresponding to that player.

The first player, step 54 reads the situation on the top card of the stack of cards assigned to that player. That player then attempts to answer the question or solve the problem addressed by the selected top card. The rear of that card is then read and the answer determined correct or incorrect. If correct, that player is assigned the par value of that card, step 56. That top card is then discarded, step 58.

If all cards are played, step 60, the total points of all players is determined, step 62. Since play has just commenced, all cards have not been played and the next player in a first sequence either to the left or right of the first player reads the situation from that next player's assigned stack, step 54 and the steps described repeated.

If a player doesn't know or gives the wrong answer or wrong solution to the problem stated on that player's assigned card, that player is given a bogie point value, or par plus one point, step 62. Other point values can also be assigned a bogie value.

The player in the opposite sequence is then given the opportunity to elect to answer the problem presented and solved incorrectly by the preceding player, step 64. For example, if the play sequence is normally is to the left of a player, the latter second election sequence is made by the player to the right of the player with the incorrect solution.

Assuming normal play is to the left, then in case of an incorrect answer, the next player on the right has the first option to answer the problem answered incorrectly, step 64. If the player electing to solve the problem answers or solves the problem, step 66, correctly, that player is assigned a birdie point value or one point less than par, for example, step 68. If that player also gives an incorrect answer or solution, that second player also gets a bogie point value, or one point over par, step 70.

In the case where the player who elects to answer gets a bogie and wrong answer, the next player in that second sequence, for example, to the right of that player gets the option to answer the problem and so on until all players have the opportunity to answer the problem if they so choose. When the situation is either correctly answered, or no more players are left to answer the problem presented, then that card is discarded, step 72. Play then continues in the first normal sequence to the player to the left of the player who first answered incorrectly.

The play then repeats as described until all cards have been played. If all cards have been played then the scores are totaled and the player with the lowest score wins that round.

While eighteen holes are described, any number of holes may be played in a given round with any number of par value cards. All players must be given the same number of par value cards in each instance.

In the optional games where the stacks are assigned to players based on any preassigned order, play resumes with those stacks as described above for medal play.

In Stableford Tournament, each player is dealt the cards face up as before with the situations on the top cards exposed. The players then in sequence present the scenario problem or situation on one of the cards of their stack. They try to answer the problem and situation in turn as described above.

A correct answer earns that player a par of two points and an incorrect answer or I don't know answer, a bogie or one point. A player in the opposite sequence then has the opportunity to elect to answer the problem. If the answer is correct, then a birdie or three points are assigned that player. Play continues in that same opposite sequence until all players have the opportunity to answer when no correct answer is given or until a correct answer is given.

A card is discarded from the stack of each player who participates to answer the problem presented by the initial incorrectly answered problem. That card is also discarded when play is completed on that card. Highest scorer wins.

In first version of Match play for two to four players, each player is dealt eighteen cards as described above. In turn, each player presents the scenario on any card of his stack of cards. That player then attempts to provide the solution or answer as above. If correct, that player receives a +1 point. If the player doesn't know or answers incorrectly, the player is given a −1 point.

That problem or situation is then up for answer on a first come first serve basis to all players. The points are assigned accordingly and that card is then discarded after play with it is completed. The player with the most holes won, i.e., +1 points, is the winner. In the alternative, the player with the most arithmetical sum of net + points after subtracting the − points is the winner.

In an alternative Match play game, four players form two teams of two players each. Each team is dealt 18 cards including cards from each par value portion. Either of the teams, e.g., team 1, poses the problem or situation on any one of their cards to the other team, e.g., team 2, preferably the top card. The answering team 2 members may confer with each other and either team 2 member may respond. A + 1 score is given to that team 2 for a correct answer. A wrong answer earns no points and that team may be down one hole for that hole.

The other team, e.g., team 1, then takes its turn at answering the problem or situation on a card presented by team 2. If the team 1 answers correctly, then this team earns a +1 score for the same hole. There is no winner for that hole since both teams have the same number of points for the same hole. If both teams answer incorrectly, there is no winner for that hole. Each card is discarded after it is played.

The teams take turns asking and answering until the 18 cards of each team are played or, in the alternative, until any number of cards as prearranged are played. The team with the most + points is the winner.

In the alternative, in match play, the players may play against one another similarly as the teams as described above. The players each play with a personally assigned stack of cards. In this case, if four players are playing, the players play in sequence, and wrong answers can be answered by other players in a sequence. As each player takes a turn, his top card is discarded regardless the correctness of his answer.

If correct, he gets a + point for that hole or nothing if incorrect. If incorrect the next player takes a turn at answering the same card. All players except the first player can participate, as in all of the above games, since the first player will know the answer on his card. He therefore is ineligible to participate in answering his drawn card. If all players answer correctly for a given hole, then there is no winner of that hole. The play proceeds until all cards are played. The winner is the player with the most + points.

The 19th hole game is played by piling the cards on a table. All players take turns picking the cards at random. Points are assigned based on correct or incorrect answers as agreed upon. The player with the most or fewest points after all cards are played, as agreed upon, is declared the winner.

It should be understood that the term "bogie" and "birdie" values as used in certain of the claims do not necessarily refer to respective higher and lower values relative to par values as used in a typical actual golf game. For example, a bogie value as claimed in certain of the claims may also be a value lower than the assigned value for a correct answer and a birdie may be a value higher than the assigned value for a correct answer. The values of birdies and bogies, and par assigned each card, may also depend upon agreement of the players when playing a given game.

In an alternative embodiment, the games disclosed herein can be played on a computer wherein the card information is displayed on the computer terminal display. In this embodiment, the cards are text images which are replicas of the rules and situations depicted above herein. The images are designated with corresponding card numbers for purposes of identifying a given card. See the table above regarding RULES FOR STROKE PLAY.

The card numbers with the appropriate information are programmed to be dealt and drawn randomly by one or more players. In a computerized system the term "card" merely refers to the images depicting the situation or problem and its corresponding answer. Cards, in fact, as literally interpreted need not used. The images may be graphically drawn to represent cards, but this is not essential. The images representing a situation and its corresponding rule therefore are referred in the claims as "cards."

For example, a situation may be presented in the image with the par value appearing therewith. Also, the images may be colored to correspond to the par values, but this too is not essential.

When cards are dealt in the computer game, the computer randomly selects and assigns the desired number of cards in a particular game for each player from a large population of cards. Therefore, the term "dealing" as used in the claims refers to the step of assigning players by the computer images corresponding to discrete cards. Each player is assigned or dealt a so called stack of cards or corresponding situations and rules each manifesting a card representing holes. The computer keeps track of the cards for each player.

Play commences as described above for discrete playing cards for each game. The terms "front" and "rear" face as used in the claims refers to the respective situations and rules as stored in computer memory corresponding to a discrete card front and rear face. Therefore, in the claims, the step of "looking at the front or back of the top card" merely refers to selectively displaying by the computer the corresponding situation or rule and answer. The computer is a substitute for a deck of cards drawn from a larger population of cards.

Conventional computer keyboard controls are used to control the play of the game. Thus as used in the claims, the term "dealt" cards refers to the computer selecting images of text corresponding to a playing situation and its corresponding rule or answer. The term front and back as used in the claims refers to the corresponding images of situations and answers or applicable rules.

It should be understood therefore, that in the claims, the step of dealing each player a stack of cards refers to the computer assigning each player a stack of corresponding cards and keeping track of the cards assigned to each player during the play of the game. Discarding a card refers to the computer removing the images of a card from the player's stack. The computer is programmed to do this upon command.

In the playing mode, a player uses a keyboard control to tell the computer to call up that player's stack of cards. This stack is then shown by the display one card at a time front face up. That player then reads the situation to other players out of sight of the display. That player also momentarily calls up the answer or applicable rule corresponding to the card rear face. The player then reads the answer or rule to himself. Then the display is returned to the situation representing the card front face. This step corresponds to looking at the back of card to read the answer.

Play thus commences and continues for each player taking turns at the computer when that player has a turn to draw a card. When play is completed by the players for a card, the computer is instructed to discard that card. When cards of multiple players need to be discarded, instructions are given the computer to do so.

It will occur to one of ordinary skill that various modifications to the disclosed games may be made. It is intended that the scope of the invention is as defined in the appended claims.

What is claimed is:

1. A method of teaching the rules of the game of golf employing a deck of cards, each of which cards has a front and a back, the deck comprising a plurality of portions, the cards of each portion manifesting the same given value, the values of the cards of the different portions being different, each card having a golf game playing situation on the front and a corresponding rule or solution to the situation on the back, the method comprising:

dealing the same number of cards in a first set of cards from the first portion to each player in a stack with the front face up;

dealing the same number of cards in a second set of cards from the second portion to each player on that players stack with the front face up;

dealing the same number of cards in a third set of cards from the third portion to each player on that players stack with the front face up so that the total number of cards dealt to each player in each player's stack corresponds to the total number of holes in a golf game being played; and playing the game by:

a) declaring by a first player the rule or answer to the situation on the top card of the first player's stack;

b) if the answer is correct by looking at the back of the top card, assigning the first player the value manifested by that card and discarding that card;

c) in case of a wrong answer, assigning that first player at least one additional point added to the value manifested by that top card;

d) allowing a second player in a first sequence at the second player's option to provide the rule or answer to the card with the wrong answer;

e) assigning the value manifested by that top card less at least one point to the second player if the answer is correct and causing that second player to discard a card of his stack manifesting the same value as the top card of the first player's stack;

f) if the answer is incorrect, assigning the second player at least an additional point added to the value manifested by that top card and causing that player to discard a card from that player's stack having a value manifesting that same value as the top card of the first player's stack;

g) repeating steps e and f until all players in the first sequence have the option to provide an answer if each preceding player in the first sequence fails to provide a correct answer for that top card;

h) repeating steps a–c with each remaining player in a second sequence and repeating steps d–g for each incorrect answer when applicable in the first sequence;

i) totaling all the points of each player after all cards in all of the stacks have been played; and j) declaring the winner the player with the lowest amount of points.

2. The method of claim 1 wherein the numeral manifested by each portion is on each card.

3. The method of claim 1 wherein the total number of cards in the deck is X times the number of players, where X is the number of holes to be played.

4. The method of claim 1 including forming each card with at least one of a color or pattern wherein the color and pattern of each card manifests the value of each card of each portion.

5. The method of claim 4 including forming each card with the value of each color and pattern on that card.

6. The method of claim 5 wherein forming the value on each card includes forming the cards in the first portion with a value of three, the cards in the second portion with a value of four and the cards in the third portion with a value of five.

7. The method of claim 1 including for a wrong answer further assigning a penalty value to a portion of the cards on the back of each such cards which penalty value is added to the value manifested by the corresponding card.

8. A method of teaching the rules of the game of golf employing a deck of cards, each of which cards has a front and a back, the deck comprising a plurality of portions, the cards of each portion manifesting the same given par value, the par values of the cards of the different portions being different, each card having a golf game playing situation on the front and a corresponding rule or solution to the situation on the back, the method comprising:

dealing a set of cards from each portion to each player in a stack in the same portion sequence with the front face up so that the total number of cards dealt to each player corresponds to the total number of holes in a golf game being played, each player receiving the same number of cards in each set; and playing the game by:

a) declaring by a first player the rule or answer to the situation on the top card of a first stack corresponding to the first player in a first sequence of players;

b) if the answer is correct by looking at the back of the selected top card, assigning the first player the par value manifested by that selected card and discarding that card from its stack;

c) in case of a wrong answer, assigning that first player at least an additional point added to the value of the par value manifested by that selected top card;

d) allowing a second player in a second sequence at the second player's option to provide the rule or answer to the card with the wrong answer;

e) assigning the value manifested by that top card less at least one point to the second player if the answer is correct and discarding the first player's selected top card and the top card of a second stack manifesting the same par value as the top card of the first player's selected first stack, said second stack corresponding to the second player;

f) if the answer is incorrect, assigning the second player at least an additional point added to the value of the numeral manifested by that selected top card and discarding the top card of said selected second stack;

g) repeating steps a–c with each remaining player in the first sequence and repeating steps d–f for each incorrect answer when applicable in the second sequence;

h) totaling all the points of each player after all cards in all of the stacks have been played; and i) declaring the winner the player with the lowest amount of points.

9. The method of claim 8 wherein there are three portions, a first portion manifesting a par value of 3, a second portion manifesting a par value of 4 and the third portion manifesting a par value of 5.

10. The method of claim 9 wherein the first and third portions comprise the same number of cards each.

11. A method of teaching the rules of the game of golf employing a deck of cards, each of which cards has a front and a back, each card having a golf game playing situation on the front and a corresponding rule or solution to the situation on the back, the method comprising:

dealing a stack of cards to each player with the front face up, the number of cards in the stack representing the number of holes in the golf game being played; and playing the game by:

a) declaring by a first player the rule or answer to the situation on the top card of a selected stack corresponding to that first player;

b) if the answer is correct by looking at the back of the top card of the selected stack, assigning the first player a first point value and discarding that card;

c) in case of a wrong answer, assigning that first player a second given point value greater than the first value;

d) allowing a second player in a first sequence at the second player's option to provide the rule or answer to the card with the wrong answer;

e) assigning the second player a third given point value lower than the first value if the answer is correct and discarding the card from a stack corresponding to the second player;

f) if the answer is incorrect, assigning the second player the second given point value and discarding a card from the second player's corresponding stack;

g) repeating steps e and f until all players in the first sequence have the option to provide an answer if each preceding player in the first sequence fails to provide a correct answer for that top card;

h) repeating steps a–c with each remaining player in a second sequence and repeating steps d–g for each incorrect answer when applicable in the first sequence;

i) totaling all the points of each player after all cards in all of the stacks have been played; and j) declaring the winner the player with the lowest amount of points.

12. The method of claim 11 wherein the first point value is two, the second point value is three and the third point value is one.

13. A method of teaching the rules of the game of golf employing a deck of cards, each of which cards has a front and a back, each card having a golf game playing situation on the front and a corresponding rule or solution to the situation on the back, the method comprising:

dealing a stack of cards to each player with the front face up, the number of cards in the stack representing the number of holes in the golf game being played; and playing the game by:

a) declaring by a first player the rule or answer to the situation on any card of that player's stack;

b) if the answer is correct by looking at the back of the selected card, assigning the first player a (+) point value and discarding that card;

c) in case of a wrong answer, assigning that first player a (–) point value;

d) allowing any further player on a first come first serve basis at that further player's option to provide the rule or answer to the card with the wrong answer;

e) assigning the further player a (+) point value manifesting a won hole if the answer is correct and (–) point value manifesting a lost hole if incorrect;

f) discarding that card when play with that card is completed;

g) repeating steps a–f until all cards have been played;

h) totaling all the of holes won for each player after all cards in all of the stacks have been played; and i) declaring the winner the player with the most won holes.

14. The method of claim 13 wherein the winner is the player with highest value of the arithmetic sum of the won and lost holes.

15. A method of teaching the rules of the game of golf employing a deck of cards, each of which cards has a front and a back, each card having a golf game playing situation on the front and a corresponding rule or solution to the situation on the back, the method comprising:

dealing a stack of X cards; and playing the game by:

a) assigning a plurality Y of players each having a playing turn in a sequence and where X/Y is an integer;

b) drawing a card from the stack and declaring by a first player in the sequence the rule or answer to the situation on that card;

b) if the answer is correct by looking at the back of the selected card, assigning the first player a first given point value and discarding that card;

c) in case of a wrong answer, assigning that first player a second point value which is one of a lower or higher value than the first point value;

d) repeating steps a–c for each player in the sequence in case of a wrong answer and discarding that card when play with that card is completed by the players;

e) repeating steps a–d for each player until all cards have been played;

h) totaling all the of points of each player after all cards in all of the stacks have been played; and i) declaring the winner the player with the one of the least or most amount of points when the answer in step (c) is assigned a higher value and lower value, respectively, than tile first point value.

16. A method of teaching the rules of the game of golf employing a deck of cards, each of which cards has a front and a back, each card having a golf game playing situation on the front and a corresponding rule or solution to the situation on the back, the method comprising:

assigning each card a par value representing the value of a hole in the game;

dealing the same number of cards to each of a plurality of players, each player receiving the same number of the same par value cards; and drawing and declaring by each player in a given turn sequence the answer to the situation on the drawn card;

assigning a par value of the drawn card to that player for a correct answer;

assigning a bogie value to that player for an incorrect answer;

permitting at least one other player to play that drawn card having an incorrect answer;

assigning that at least one other player a birdie value for a correct answer and a bogie value for an incorrect answer;

discarding that drawn card and a card from the dealt cards of the at least one other player; and totaling the points of all players when all cards have been played and declaring the player with a prearranged one of the lowest and highest score the winner based on the relative values of the bogie and birdie values.

17. A method of teaching the rules of the game of golf employing a deck of cards, each of which cards has a front and a back, each card having a golf game playing situation on the front and a corresponding rule or solution to the situation on the back, the method comprising:

dealing the same number of cards to each of a plurality of teams of players, each team receiving the same number of the same par value cards; and a) drawing a card and reading by one player of a team the situation on the drawn card;

b) causing a player from another team to declare the answer to the situation on the drawn card;

c) assigning a + value to the team of that player declaring the correct answer;

d) discarding that drawn card from the dealt cards of the team drawing the card;

f) repeating steps a–e for each team in sequence until all cards have been played; and declaring the winner the team with the most + points.

18. The method of claim 17 including permitting the answering team players to consult with one another and permitting any team member to provide the answer.

19. The method of claim 17 including permitting other teams to answer incorrectly declared answers of situations and if that team declares a correct answer, assigning that team a + point value and discarding a card from that team's cards.

20. The method of claim 17 wherein there are two teams each comprising two players and step (a) comprises drawing any card from a team's dealt cards.

* * * * *

UNITED STATES PATENT AND TRADEMARK OFFICE

CERTIFICATE OF CORRECTION

PATENT NO. : 5,497,999

DATED : March 12, 1996

INVENTOR(S) : Charles P. Stewart et al.

It is certified that error appears in the above-indentified patent and that said Letters Patent is hereby corrected as shown below:

column 5, line 55, change "land" to --and--.

column 23, line 47, change "tile" to --the--.

Signed and Sealed this

Eighteenth Day of June, 1996

*Attest:*

*Attesting Officer*

BRUCE LEHMAN

*Commissioner of Patents and Trademarks*